United States Patent [19]

Chlystun

[11] 4,066,190

[45] Jan. 3, 1978

[54] CONTAINER WITH COLLAPSIBLE POURING SPOUT AND IMPROVED RECLOSING MEANS

[76] Inventor: Walter K. Chlystun, 327 St. James Drive, Spartanburg, S.C. 29301

[21] Appl. No.: 725,099

[22] Filed: Sept. 20, 1976

Related U.S. Application Data

[63] Continuation of Ser. No. 630,509, Nov. 10, 1975, which is a continuation of Ser. No. 420,964, Dec. 3, 1973, abandoned.

[51] Int. Cl.[2] ..... B67D 3/00

[52] U.S. Cl. ..... 222/529; 222/541

[58] Field of Search ..... 222/143, 183, 528, 529, 222/484, 530, 541, 562; 220/266, 270, 306

[56] References Cited

U.S. PATENT DOCUMENTS

| | | | |
|---|---|---|---|
| 2,772,821 | 12/1956 | Phillips | 222/520 |
| 2,895,654 | 7/1959 | Ricke | 222/529 |
| 3,128,016 | 4/1964 | Ferri, Jr. | 222/541 X |
| 3,187,966 | 6/1965 | Klygis | 222/541 |
| 3,298,577 | 1/1967 | Chlystun | 222/529 |
| 3,690,522 | 10/1970 | Chlystun | 222/529 |

*Primary Examiner*—Allen N. Knowles
*Assistant Examiner*—Norman L. Stack, Jr.
*Attorney, Agent, or Firm*—Wellington M. Manning, Jr.; Luke J. Wilburn, Jr.

[57] ABSTRACT

A recloseable, dispensing container is disclosed herein. The container, preferably a blow molded container, has at least one side wall with a nestable dispensing spout secured thereto. Most preferably a wall, top and spout are integral having been blow molded with a bottom being provided by way of a metal cap or the like during the filling operation. Initially the pouring spout is nested within the container and is extractable to a dispensing position. A cover is secured to the top pouring spout and is removable therefrom to permit dispensing. The cover is adapted so as to be replaceable after removal, over the pouring spout to reclose and reseal same. The cover is provided with means internally thereof which mate with the spout or a portion thereof to reseal the spout after the cover has been removed.

10 Claims, 6 Drawing Figures

CONTAINER WITH COLLAPSIBLE POURING SPOUT AND IMPROVED RECLOSING MEANS

CROSS REFERENCE TO RELATED APPLICATION

This application is a continuation of application Ser. No. 630,509, filed Nov. 10, 1975, which is a continuation of application Ser. No. 420,964, filed Dec. 3, 1973, now abandoned.

BACKGROUND OF THE INVENTION

Development of the container art, at least insofar as containers for packaging of various and sundry liquids, has progressed in the direction of providing containers with self-opening means. Further, certain of these containers are adapted with pouring spouts that are affixed to the container in some fashion to facilitate the dispensing of the contents from the container. Certain of such efforts have resulted in U.S. Pat. Nos. 3,298,577 and 3,690,522 to Chlystun, both of which teach self-contained dispensing spouts in conjunction with a container.

Certain containers are provided with a combined opening means and pouring spout, whereby upon lifting or disengaging the opening means from the top of the container, a pouring spout secured to the underside thereof is withdrawn from a nested position in the container. Such is the case with the two aforementioned patents. After withdrawal of the pouring spout, the opening means are separated from the spout whereby the contents of the container may be dispensed therethrough.

Containers of the type mentioned above are quite suitable for use in the storing and dispensing of oil, hazardous chemicals, fuels and other household and industrial compositions. An independent opener and/or spout is no longer required for use with the type containers previously described. Moreover, while certainly these prior art containers are an advance in the art, deficiencies still exist. These deficiencies are based upon the fact that once opened, the existing containers cannot be conveniently reclosed in such a manner so as to conveniently reseal the spout. U.S. Pat. No. 3,690,522 does teach a recloseable cover for a pouring spout. The present invention is an advance over this type of reclosing mechanism. In other words, the present invention has further improved the container art by providing a removable pouring spout cover that once replaced on the pouring spout recloses and reseals the pouring spout so that the container may be further used without the danger of spillage, vaporization or the like of the contents.

The prior art includes U.S. Pat. Nos. 2,533,305 to Wells; 2,685,385 to Kuss; 2,895,654 to Rieke; 3,042,271 to Winstead; 3,298,577 to Chlystun; 3,326,421 to Peace; 3,481,515 to Booth et al; 3,502,246 to Kelbch; and 3,690,522 to Chlystun.

SUMMARY OF THE INVENTION

It is an object of the present invention to provide a container having a self-contained, self-opening, resealable pouring spout.

A further object of the present invention is to provide an improved dispensing container for liquids having a removable, resealable pouring spout nested therein prior to dispensing.

Yet another object of the present invention is to provide an improved blow molded container having a pouring spout associated therewith, the improvement being directed to the improved recloseable, resealable cover integral with, but removable from the pouring spout.

Still another object of the present invention is to provide a container having an integral pouring spout and a mating integral cover for resealing the spout once it is opened.

Generally speaking, the present invention relates to a recloseable, dispensing container comprising a container body; a dispensing spout secured to said body; a cover integral with said dispensing spout and removable therefrom, said spout having a weakened tear line therearound, severence of which separates said cover from said spout to permit dispensing from said spout, said spout further having reseal means adjacent said tear line; and said cover having reseal means mateable with reseal means on said spout, said cover reseal means being on the inside thereof, whereby said cover can be employed to reseal said spout.

More specifically, the present invention relates to a container for packaging and dispensing liquids such as oil, chemicals and the like, the container being self-contained, in that, a combined cover and opening means is provided at the top of the container which, when lifted, withdraws a pouring spout from its nested position within the container to an extended pouring position. At the top of upward movement of the pouring spout, the combined opening and covering means separates therefrom upon continued upward movement whereby the spout is opened to permit dispensing of the contents of the container. Further, once the cover is torn or cut away from the pouring spout, a skirt portion of the cover is provided that is passable over an upper end of the spout, where means on the spout and within the cover mate to reseal the spout. The reseal means may include friction fit, snap seal rings, threaded means, and the like. An annular ring at the top inside of the cover may be provided which is enclosed on three sides, with only the lower side being open so as to permit the ingress and egress of an enlarged spout area therein. The enlarged spout area preferably a ring or flange around the upper end of the spout is frictionally engaged with the cover at the upper enclosed ring and reseals the spout.

A further approach to reseal of the dispensing spout is to provide threads around the spout with matching threads inside the cover. A screw cap arrangement may then be employed to reseal the dispensing spout. Likewise, other mateable reseal means may be employed.

DESCRIPTION OF THE PREFERRED EMBODIMENTS

Figure 1:
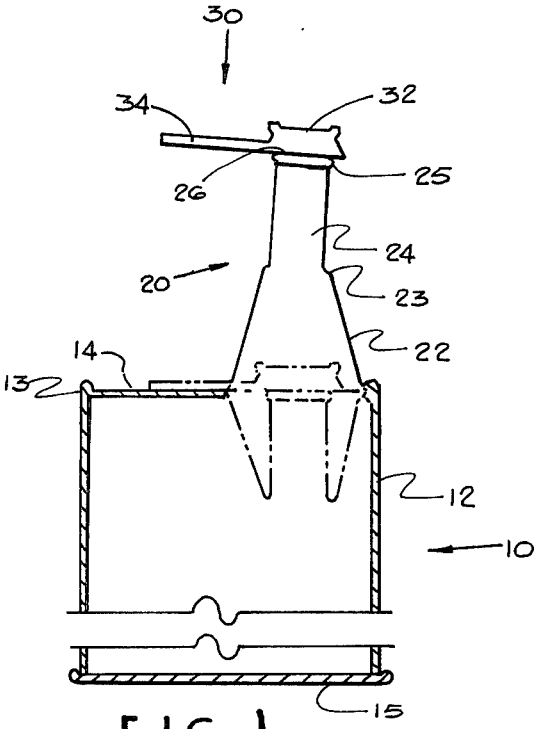
FIG. 1 is a partial side cross sectional view of a container with spout according to the teachings of the present invention.
Figure 2:
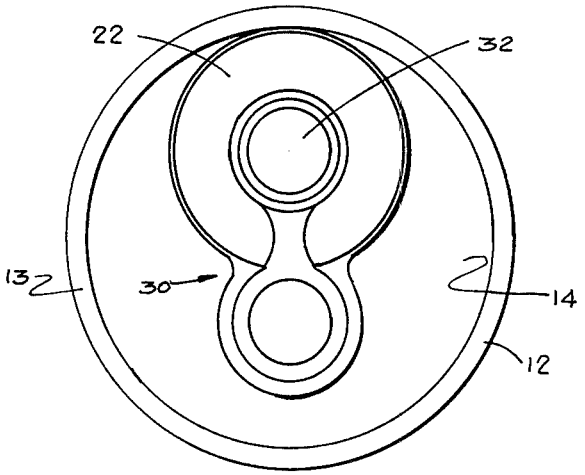
FIG. 2 is a top view of a container as shown in FIG. 1 with the spout in the nested position.

Making reference to the Figures, preferred embodiments of the present invention will now be described in detail. In FIGS. 1 and 2, a container generally indicated as 10 is shown having body walls 12 and a top wall 14. Top wall 14 preferably has a lip 13 therearound and is provided with a pouring spout generally indicated as 20 shown secured thereto, and preferably integral therewith. Pouring spout 20 is also shown in phantom in FIG. 1 as being nestable within container 10. Spout 20 has a cover generally indicated as 30 secured to the top thereof with a tear line 26 therebetween. Cover 30 is made up of a cap 32 that is positioned immediately above spout 20 adjacent tear line 26 with a laterally extending portion 33 having an opening 34 to receive a finger or the like therein. As such, one can grasp cover 30 at opening 34 and lift upwardly, pulling spout 20 from its nested position within container 10 to an extended, pour position. Cap 32 may then be torn from spout 20 by a continued pulling motion, separation occurring at a tear line 26. In certain containers a tear line 26 may be omitted, whereby it becomes necessary to simply cut cover 32 from spout 20 after spout 20 is withdrawn from its nested position.

Container 10 with pouring spout 20 is preferably a completely integral structure, as would be produced by blow molding for example. On the other hand, if desirable, a separate spout and cover combination may be utilized and secured to a top 14, or as the case may be, top 14, spout 20 and cover 30 may be integral and thereafter secured to a separate container 10 having side walls 12 and a bottom wall 15. It is greatly preferred, however, that the side walls, top, spout and cover be of integral construction as provided by blow molding since this particular combination exhibits good strength characteristics and performs quite well on conventional high speed fill equipment.

Figure 3:
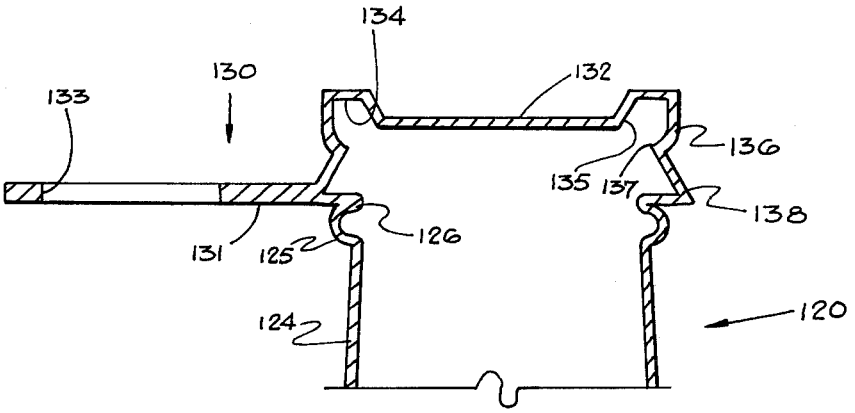
FIG. 3 is a partial side cross sectional view of a sealed spout and cover according to the teachings of the present invention.
Figure 4:
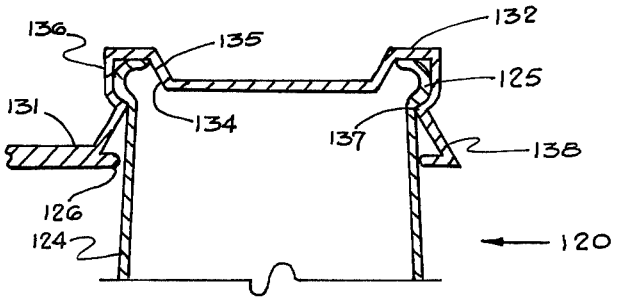
FIG. 4 is a resealed spout in cross section according to the embodiment of the present invention as illustrated in FIG. 3.

As mentioned above, and as more specifically described hereinafter, it is desirable that the cover 30 for spout 20 as disclosed herein be provided with reseal means that mate with a portion of spout 20 so as to reseal spout 20 after the cover has been removed and the spout has been opened for dispensing of the contents of the container. FIGS. 3 and 4 illustrate one embodiment of such a reseal feature.

In FIG. 3 a cross section of an integral spout-cover 120 and 130 respectively, is illustrated. An upper section 124 of spout 120 has an enlarged flange area 125 at an upper portion thereof. Immediately adjacent flange area 125 is a weakened tear line 126 above which is located cover 130. Cover 130 includes a tab portion 131 and a cap portion 132 with the tab portion 131 being secured to the cap portion 132 and extending outwardly therefrom. An opening 133 in tab portion 131 permits insertion of a finger or the like therein for an upward pulling motion on tab 131 to withdrawn spout 120 from its nested position within a container. Initially, cap 132 is integral with spout 120 at weakened tear line 126 and thus provides a spout 120 that is sealed and prohibits dispensing of the contents of the container to which it is secured. At the end of upward movement of spout 120, continued pulling on tab 131 will cause cap 132 to break away from spout 120 at weakened tear line 126 so as to open spout 120 for dispensing purposes. As shown in FIG. 3, cap 132 has an internal annulus 134 that extends around an upper portion thereof being bordered by depending side walls 135 and 136 and a protruding shoulder 137 that is biased inwardly by a skirt 138. As shown in FIG. 4, once cap 132 is separated from spout 120 at weakened tear line 126, cap 132 may be used not only to reclose spout 120, but also to reseal spout 120. In the resealing function, enlarged flange 125 on spout 120 passes inwardly of cap 132, deflecting skirt 138 outwardly so as to permit passage by shoulder 137 whereby flange 125 resides within internal annulus 134 of cap 132. As shown in FIG. 4, it is preferred that enlarged flange 125 of spout 120 and the internal configuration of annulus 134 not only mate, but produce a snug form fit as illustrated in FIG. 4, whereby a better sealing arrangement is achieved. In this regard, note that the curvature of side wall 136 of cap 132 conforms adjacent shoulder 137 to the external lower curvature of flange 125. Flange 125 is thereby biased upwardly and inwardly within annulus 134, and held in sealing engagement therein. Cover 132 may extend straight across at annulus 134, however, whereby depending side wall 135 would not be present. The sealing relationship would still exist at the upper inside end of cover 132.

Figure 5:
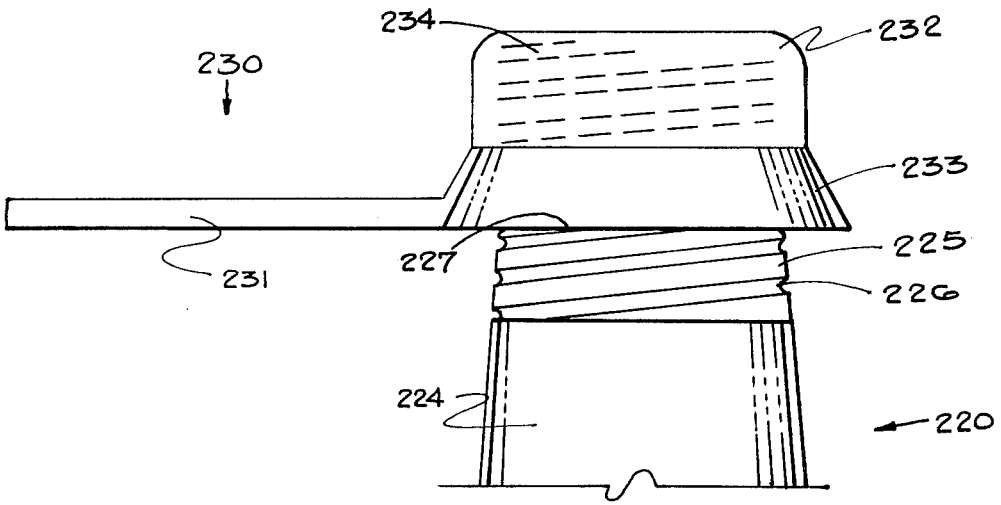
FIG. 5 is a side view of a further embodiment of the present invention showing a sealed spout and cover.
Figure 6:
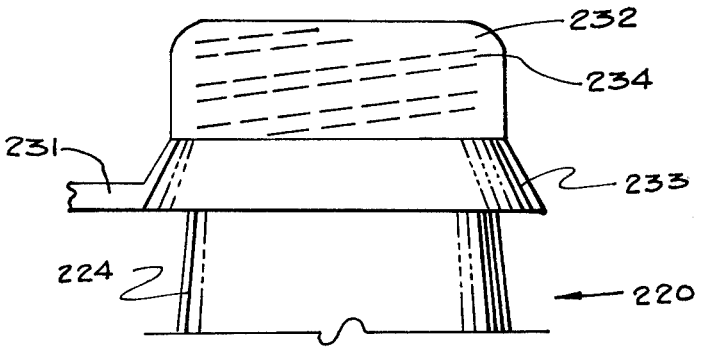
FIG. 6 is a side elevational view of a resealed spout according to the embodiment of FIG. 5.

A further embodiment of the resealing arrangement of the present invention is illustrated in FIGS. 5 and 6. In FIG. 5 a portion of a spout 220 is shown having an upward spout section 224 with a forward end 225. Forward end 225 of spout 220 is provided with a plurality of exterior threads 226 received thereon. Adjacent forward end 225 of spout 220 is a separating line 227 above which cover 230 resides. Separating line 227 may be a weakened tear area or may be an area where a knife or the like may be used to sever the separate parts and thus open spout 220 for dispensing. Cover 230 is provided with a resealable cap 232 and a tab 231 extending outwardly therefrom. Cap 232 has an internal configuration that mates with the upper portion 225 of spout 220 so as to reseal spout 220 after it has been opened. In this regard, cap 232 has a skirt 233 depending therefrom and flairing outwardly so as to pass over end 225 of spout 220. Internally of cap 232 and upwardly from skirt 233 are threaded depressions 234 that mate with threads 226 on spout 220 and permit cap 232 to make an approximate quarter turn to reseal spout 220. It should be pointed out that the threaded arrangement could likewise be reversed where spout threads 226 are depressions and internal cap threads 234 are projections or wide threads. The projections would not necessarily be continuous, but only a sufficient number for sealing alignment with depressions 226. Likewise, tab 231 of cover 230 may be provided with means for lifting to raise spout 220.

While various embodiments have been illustrated, it should further be pointed out that the various embodiments are interchangeable. Likewise, after having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A resealable dispensing container comprising:

a. a container body;

b. a dispensing spout secured to said body;

c. a cover integral with said dispensing spout and removable therefrom, said spout having a weakened tear line therearound, severance of which separates said cover from said spout to permit dispensing from said spout;

d. said spout further having an enlarged area adjacent said tear line; and e. said cover having an inner annular section adjacent the upper end thereof that is mateable with said enlarged area in a snap fit relationship whereby said cover can be replaced over said spout to reseal said container, said annular section being defined by concentric walls, an outside of said concentric walls having an inwardly projecting shoulder thereon defining a bottom of said section.

2. A resealable dispensing container comprising:

a. a container body;

b. a molded plastic dispensing spout secured to said body;

c. a plastic cover integrally molded with said dispensing spout to maintain a liquid seal therewith, said cover being removable from said spout along a weakened tear line connecting the cover and spout to permit dispensing of liquids from said spout;

d. the upper edge wall portion of said spout having an annular protrusion at said tear line extending radially outwardly therefrom;

e. said cover having an inner annular section at its uppermost end for mateably receiving said annular protrusion at the upper end of said spout in snap-fit, frictional gripping relationship therewith to positively reseal said container against loss of contents therefrom; and f. said cover including an exterior wall portion comprising a side skirt extending downwardly from said annular section and cooperating therewith to receive said protrusion of said spout and facilitate resilient gripping seal of said spout in said cap to prevent loss of contents of said container therefrom.

3. A resealable dispensing container as defined in claim 2 wherein said annular section of said cover comprises a pair of concentric walls extending downwardly from the upper end of said cover for receiving and frictionally engaging said protrusion of said spout, and the outer wall of said concentric walls of said cover extending inwardly to form a circular inward protrusion at the juncture with said side skirt portion of said cover for resilient engagement with the outer surface of said protrusion.

4. A resealable dispensing container as defined in claim 2 wherein said dispensing spout is integral with said container body.

5. A resealable dispensing container as defined in claim 4 wherein said spout is nestable within said container and may be withdrawn to an extended position for dispensing.

6. A resealable dispensing container as defined in claim 5 wherein said spout has a large diameter section adjacent said body and a small diameter section thereabove, said small diameter section being nestable within said larger diameter section and said large diameter section being nestable within said body.

7. A resealable dispensing container as defined in claim 2 wherein said cover has a pull tab integral therewith.

8. A resealable dispensing container as defined in claim 7 wherein said spout is located adjacent one side of said container and said tab extends outwardly from said cover across said container towards an opposite side of said container.

9. A resealable dispensing container as defined in claim 8 wherein said pull tab has a rigid receiving opening therein.

10. A resealable dispensing container as defined in claim 9 wherein said pull tab is initially secured to said container body.

* * * * *